US005979750A

United States Patent [19]

Kindell

[11] Patent Number: 5,979,750

[45] Date of Patent: Nov. 9, 1999

[54] COMPUTERIZED DELIVERY ACCEPTANCE SYSTEM

[76] Inventor: Gary J. Kindell, 1261 SW. Sudder Ave, Port St. Lucie, Fla. 34953

[21] Appl. No.: 08/715,374

[22] Filed: Sep. 12, 1996

[51] Int. Cl.[6] ..... A47G 29/12

[52] U.S. Cl. ..... 232/19; 232/1 R

[58] Field of Search ..... 232/19, 20, 1 D, 232/1 R

[56] References Cited

U.S. PATENT DOCUMENTS

| | | | |
|---|---|---|---|
| 1,179,818 | 4/1916 | Frumer . | |
| 1,405,661 | 2/1922 | Bergren . | |
| 1,443,313 | 1/1923 | DeNobili . | |
| 1,738,539 | 12/1929 | Moss . | |
| 2,577,401 | 12/1951 | Calcutt et al. | 232/1 |

FOREIGN PATENT DOCUMENTS

| | | | |
|---|---|---|---|
| 2194289 | 7/1990 | Japan . | |
| 487985 | 3/1992 | Japan . | |
| 4102585 | 4/1992 | Japan . | |
| 4267289 | 9/1992 | Japan . | |
| 5201489 | 8/1993 | Japan | 232/1 R |
| 5221486 | 8/1993 | Japan | 232/1 R |
| 6100080 | 4/1994 | Japan | 232/1 R |
| 6100083 | 4/1994 | Japan | 232/1 R |
| 6144486 | 5/1994 | Japan | 232/1 R |
| 6199392 | 7/1994 | Japan | 232/1 R |
| 6199393 | 7/1994 | Japan . | |

*Primary Examiner*—Jerry Redman
*Attorney, Agent, or Firm*—Edward M. Livingston. Esq.

[57] ABSTRACT

A computerized delivery-acceptance system has a delivery container (1) with a computer-control input door (4) and an outlet door (18). The input door has a lock (5) that can be unlocked by computer-controlled recognition of access authorization for placing delivery items (2) in the delivery container. After the delivery items are placed in the delivery container, the input door is closed and locks automatically. Then the outlet can be opened separately for receiving the delivery items. Computerized recognition (40, 13, 42, 43, 14, 44, 45, 11, 10), delivery-arrival indicia (16), memory backup (58), power backup (57), operational alarm (15), misuse alarm, compartmental containment, freezer containment (19), delivery records (16) and all-weather protection are provided as options.

38 Claims, 5 Drawing Sheets

FIG. 8
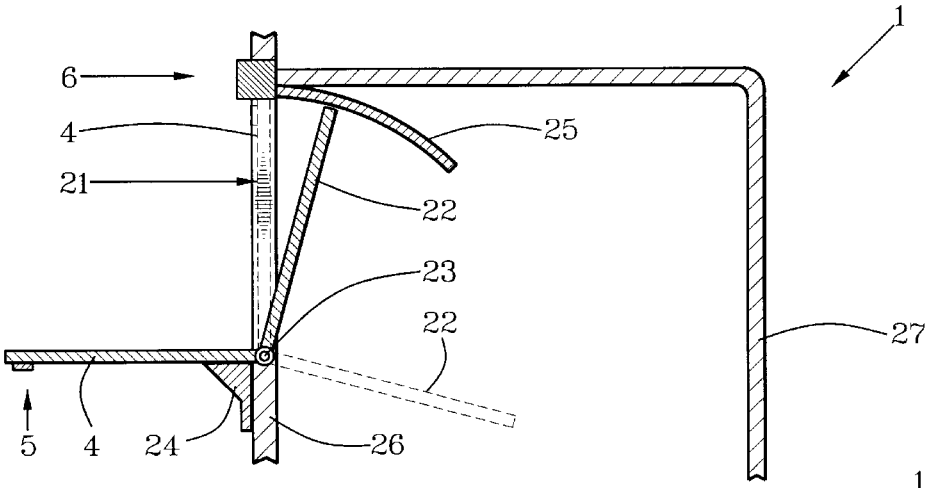
FIG. 9
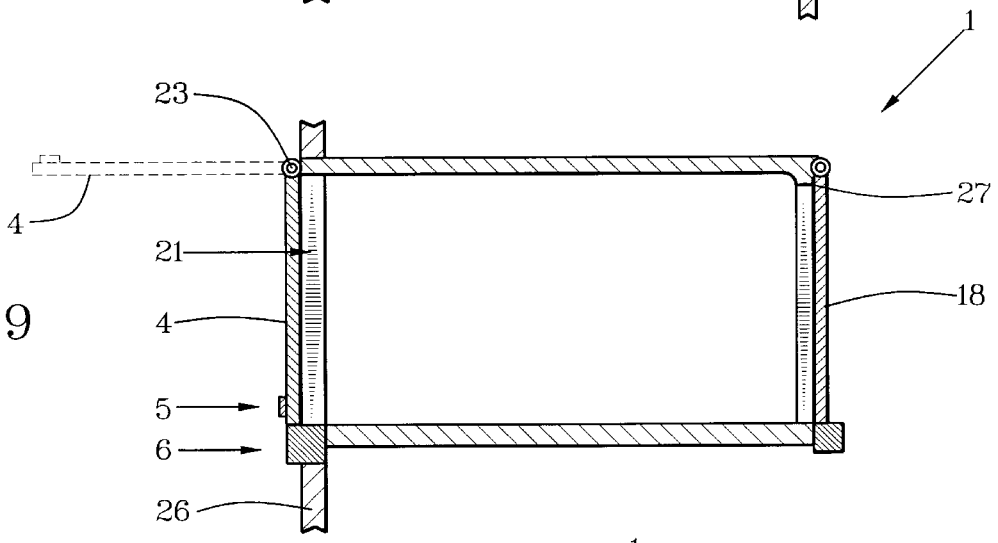
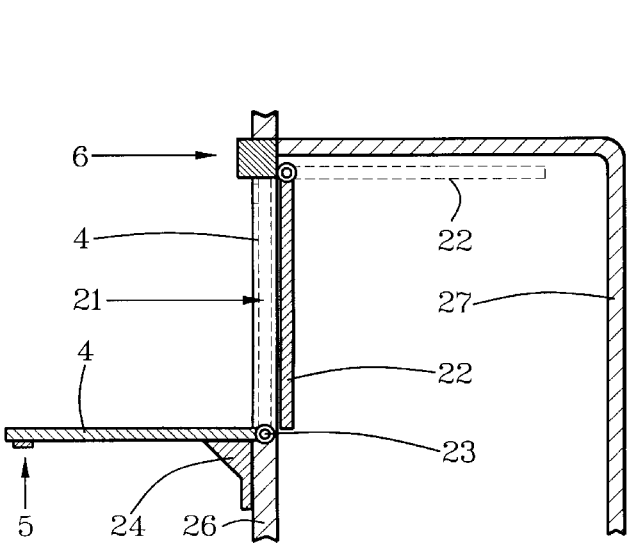
FIG. 10
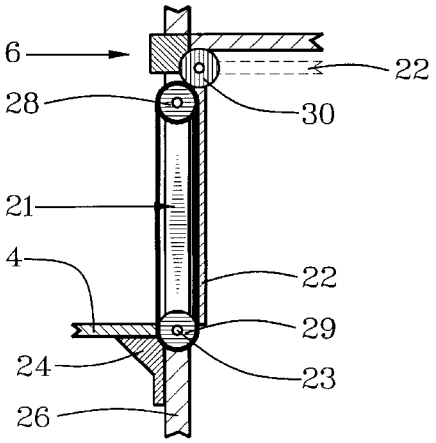
FIG. 11

TELEPHONE ELECTRONIC
KEYBOARD
NUMERICAL PAD
TELEPHONE
ELECTRICAL BACKUP
MEMORY BACKUP
COMPUTER
ALARM
DELETE
ELECTRICAL BACKUP
LOCK
AUTHORIZATION IDENTIFIER
ELECTRICAL BACKUP
MEMORY BACKUP
MEMORY BACKUP
KEYBOARD
SCANNER
AUDIO
VISUAL
ACCESS CODE
PHYSICAL OBJECT
KEY
BAR CODE
UNIVERSAL PRODUCT CODE
51
52
50
54
51
53
57
56
55
58
8
15
57
37
38
49
10
57
39
5
48
58
41
46
58
47
11
40
48
44
45
48
43
14
13
42

COMPUTERIZED DELIVERY ACCEPTANCE SYSTEM

BACKGROUND OF THE INVENTION

This invention relates to safety of home delivery with computer-controlled access by delivery personnel to a delivery box at the home.

Delivery of items to homes by delivery personnel can subject homes to criminal activity by others, by potentially maleficent deliverers, or by theft of the delivered item when left outside the home. There has been no safe, effective and affordable means to protect a home and its occupants when the home is made accessible for home delivery of items and security from theft of the delivered item.

Examples of different but related devices for protection in relation to delivery of items have been described in the following patent documents. Japanese Patent Number 2-194289, issued to Oguma, taught a delivery box or room that was freely accessible through an outside door for placing items in the box and an inside door with a peep hole in it to detect presence of and to take in delivered items. Japanese Patent Number 4-267789, issued to Ogasawara, described a bank of delivery boxes with single doors that could be opened by a telephone-actuated key. Japanese Patent Number 6-199393, issued to Ootsuka, described a single-door box for delivery with automatic locking by insertion of delivered items. Japanese Patent Number 4-87985, issued to Hotsuta, also described a single-door delivery box but with computerized identification. Japanese Patent Number 4-102585, issued to Sugimura, described a bank of single-door consignment boxes that could be opened with coded consignee keys. U.S. Pat. No. 2,577,401, issued to Calcutt, et al., taught a revolving-door service cabinet. U.S. Pat. No. 1,738,539, issued to Moss, described a compartmental service door that was manually operated from opposite sides. U.S. Pat. No. 1,405,661, issued to Bergren, described a safety delivery door on opposite sides of a delivery room or box. U.S. Pat. No. 1,443,313, issued to DeNobili, taught a revolving door with a trap door for receiving delivered items.

SUMMARY OF THE INVENTION

In light of need for improvement in protection of homes that are accessible to home delivery and prevention from theft of delivered items, objects of this invention are to provide a computerized delivery-acceptance system which:

Allows deliveries to be received at a home or business safely, regardless of whether or not someone from the home or business is present to receive delivery;

Protects against entry into a home or business that is made accessible to delivery by authorized delivery personnel;

Allows predetermined short-term or long-term standing delivery authorization by authorized delivery personnel to a home, business or other established place of delivery;

Provides computerized identification of authorization to deliver to a home or business;

Warns authorities of attempted unauthorized delivery;

Allows communication of authorization codes by telephone or other electronic means to persons or institutions to make deliveries;

Records deliveries;

Provides optional cold-storage and ambient-storage rooms for receiving deliveries;

Has backup current in the event of outages;

Has computer-controlled allowance of use of mechanical keys and identification devices; and Provides protection of delivered items from theft and adverse weather conditions.

This invention accomplishes these and other objectives with a computerized delivery-acceptance system at a home or place of business. The computerized delivery-acceptance system has a delivery container with a computer-controlled input door and an outlet. The input door has a lock that can be unlocked by computer-controlled recognition of access authorization for placing delivery items in the delivery container. After the delivery items are placed in the delivery container, the input door closes and locks. Then the outlet can be opened separately at the home or place of business for receiving the delivery items. Computerized recognition of manual identification, delivery-arrival indicia, memory backup, power backup, operational alarm, misuse alarm, compartmental containment, freezer containment, delivery records and all-weather protection are provided as options.

A method for use includes steps of communication of identification indicia to an intended deliverer of items, coding time limits for delivery, positioning delivery items for computerized recognition at the delivery container, placing the delivery items in the delivery container, automatic locking of the delivery container, and removal of the delivery items from the delivery container.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are described briefly as follows:

FIG. 8 is a cutaway side view of a delivery container having an input door that is hinged at a bottom of an entryway to a delivery container that can be used independently of a building or built onto a building and having a restrainer wall for preventing unauthorized entry through or into the delivery container;

FIG. 9 is a cutaway side view of a delivery container having an input door that is hinged at a top of an entryway to a delivery container that can be used independently of a building or built onto a building and having an outlet door in a rear or inside wall of the delivery container;

FIG. 10 is a cutaway side view of a delivery container having an input door that is hinged at a bottom of an entryway to a delivery container that can be used independently of a building or built onto a building and having a top-hinged restrainer wall that is actuated to a closed position for preventing unauthorized entry through or into the delivery container;

FIG. 11 is a cutaway side view of a means for actuating the FIG. 10 restrainer wall between open and closed mode by opening and closing of the input door;

DESCRIPTION OF PREFERRED EMBODIMENT

Figure 1:
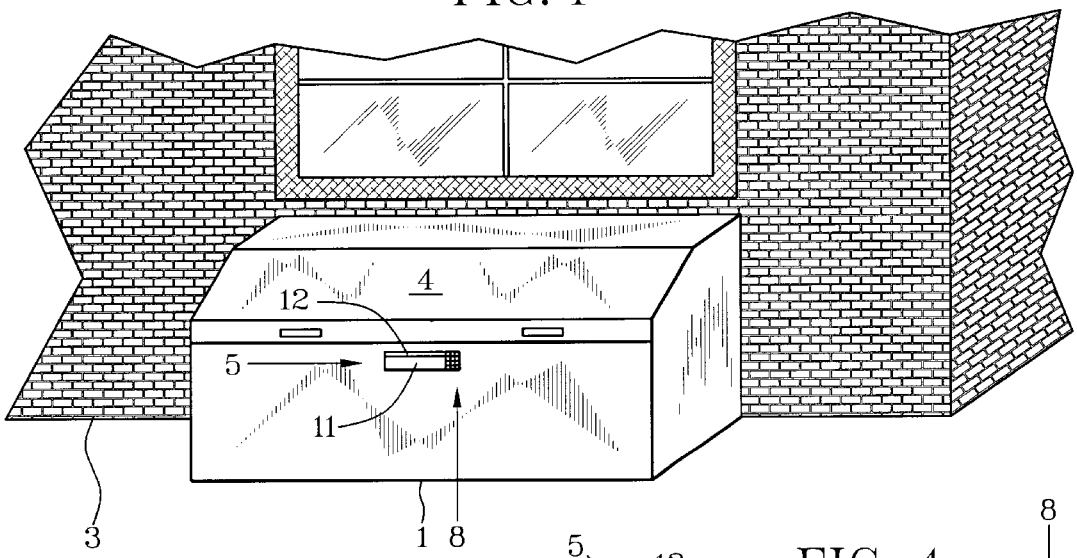
FIG. 1 is a fragmentary perspective view of a closed delivery container that is attached to a side of a house.
Figure 2:
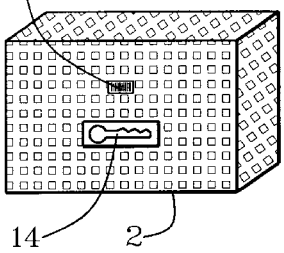
FIG. 2 is a perspective view of a delivery item containing a universal product code and a key that are representative of access codes.
Figure 3:
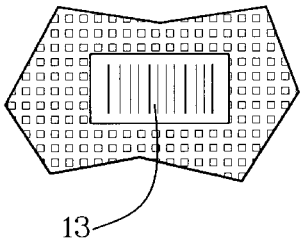
FIG. 3 is an exploded fragmentary view of the universal product code on the delivery item illustrated in FIG. 2.
Figure 4:
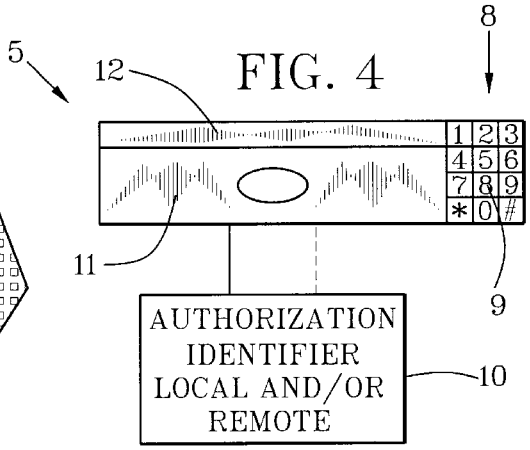
FIG. 4 is a front view of an access scanner having a numerical pad for programming, an LED readout and a diagramed relationship to local and remote detection of identification from a position on the delivery container.

In the drawings, reference is made first to FIGS. 1–5. A delivery container 1 is sized, shaped and structured to receive delivery of delivery items 2 proximate a desired building 3 such as a house as illustrated. Proximation to the desired building can be on a side, in a wall, by a side separately or part of the desired building. In this illustration, the delivery container 1 is attached to or optionally positioned closely beside a house. This embodiment of the delivery container 1 has an input door 4 that is a lid which is hinged to a top rear edge of the delivery container 1.

Figure 5:
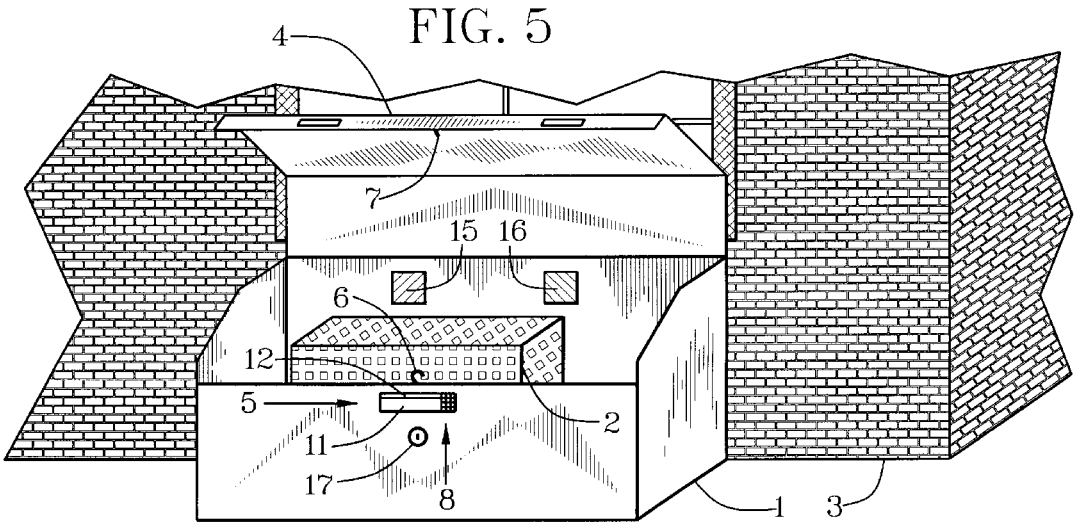
FIG. 5 is the FIG. 1 illustration with a lid to the delivery container opened and the delivery item positioned in it.

An input door 4 such as a lid is locked shut with a computer-controllable lock 5 in locking relationship between the input door 4 and the delivery container 1. The computer-controllable lock 5 can have any type of locking mechanism 6 such as a hook and latch 7 as depicted in FIG. 5 with the input door 4 open.

A computer 8 controls locking and unlocking of the computer-controllable lock 5. The computer 8 can be programmed with a keyboard such as a numerical pad 9 that can be positioned proximate an authorization identifier 10 that can employ a scanner 11. A light-emitting diode (LED) readout 12 can be included with the computer 8 for communication of select messages. The authorization identifier 10 is utilized to identify authorization for opening the computer-controllable lock 5. An authorization identifier 10 can be programmed and computer-operated locally or remotely.

The computer 8, the authorization identifier 10 and the computer-controllable lock 5 are closely associated or designedly integrated and positioned proximate a locking mechanism 6 such as a hook. Consequently, reference to the computer-controllable lock 5 connotes reference to all of these and other computer-controllable locking components unless indicated separately.

The scanner 11 or other identification detector can read an access code such as a bar code 13 or a physical object, represented by a key 14, that is associated with the delivery item 2. Positioning the access code, such as a universal product code, in visual proximity to the scanner 11 causes the computer-controllable lock 5 to release the locking mechanism 6 such as a hook or other locking means.

An alarm 15 can be positioned proximate or on the delivery container 1 to communicate locally or remotely any malfunction or maleficent operation. A recorder 16 also can be positioned proximate or on the delivery container 1 to record locally or remotely the delivery of items.

The input door 4 is also an outlet door with a separate outlet lock 17 in this embodiment. Optionally, the computer 8 can be programmed for separate unlocking of the input door 4 to obviate need for the outlet lock 17.

Figure 6:
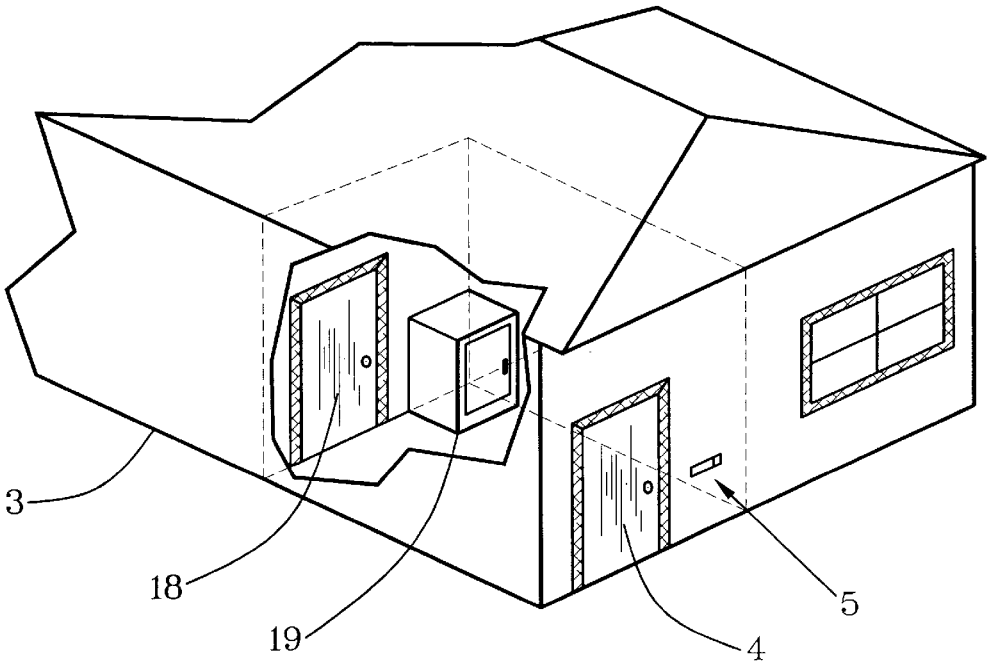
FIG. 6 is a fragmentary perspective view of a building with a special delivery room, usually called a butler room, as the delivery container.

Referring to FIG. 6, the delivery container 1 can be a room in the desired building 3 with the computer-controllable lock 5 positioned on an outside wall of the desired building. A room type of delivery container 1 can have an outlet door 18 in selective communication with other parts of the desired building. Contained in a delivery container 1, whether a room type or box type, can be various compartments such as a refrigerated section 19.

Figure 7:
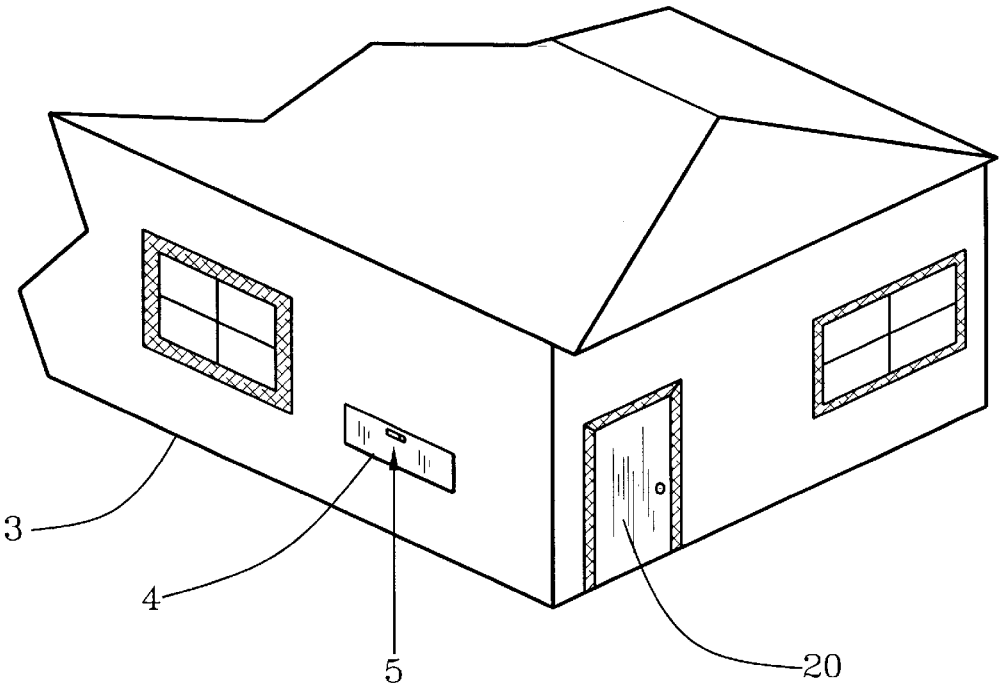
FIG. 7 is a fragmentary perspective view of a building with a delivery container positioned in an outside wall.

Referring to FIG. 7, the input door 4 can be in a side of a desired building 3 having separate building doors 20. For this, the computer-controllable lock 5 is positioned in or on the input door 4.

Referring to FIGS. 8–11, a delivery container 1 can be freestanding and separate from a desired building 3 or variously attached to or a part of the desired building 3 described in relation to FIGS. 1 and 5–7. No bottom is shown for the delivery containers 1 depicted in FIGS. 8 and 10–11, in particular, because the bottoms can be optionally either bottoms of separate delivery containers 1 or bottoms of buildings in which the delivery containers 1 are positioned.

In FIG. 8, the input door 4 is attached pivotally to a bottom side of an entryway 21 to a delivery container 1, such that the input door 4 pivots vertically to a vertical attitude in a closed mode and to a horizontal attitude in an open mode. A restrainer wall 22 is extended at a desired preferably obtuse angle from proximate an attachment axis 23 of the input door 4. In the horizontally open mode, the input door 4 can be made to rest on a door support 24. The input door 4 has a table relationship to the entryway 21 for receiving delivery items. The restrainer wall 22 then pivots to design upright attitude for preventing unauthorized entry into or through the entryway 21. An entry guard 25 can be extended arcuately to further prevent unauthorized entry. With the input door 4 in a vertically closed mode as shown in dashed lines, the restrainer wall 22 pivots to a downward slant to allow delivery items to drop off to a floor of either a separate delivery container 1 or to a floor of a desired building 3 described in relation to FIGS. 1 and 3–7. A front wall 26 of the delivery container 1 can be optionally either a wall of a building or of a separate delivery container 1.

In FIG. 9, the delivery container 1 has an input door 4 proximate hinged to a top of a front wall 26 and an outlet door 18 hinged to a top of a rear wall 27. In this embodiment also, the delivery container 1 can be separate from, attached to or part of a desired building 3 described in relation to FIGS. 1 and 3–7. The input door 4 and the outlet door 18 with lock are shown hinged to a top side of a delivery container 1 but can be hinged to any side.

In FIGS. 10–11, the input door 4 is hinged to a bottom of an entryway 21 as in FIG. 8. Also, there is a restrainer wall 22, but it is hinged to a top of the entryway 21 separately. Instead of being attached to the input door 4 for restrainable positioning, the restrainer wall 22 is pivoted by contact with a top pulley wheel 28 that is rotated by a bottom pulley wheel 29 that is connected to the input door 4 at the attachment axis 23. There is direct gear drive between the top pulley wheel 28 and a restrainer wheel 30. Opening the input door 4 to a horizontally open attitude pivots the restrainer wall 22 to a vertically closed attitude in relation to the entryway 21. The pulley wheels 28 and 29 and related gearing can be secluded and covered to prevent contact at the entryway 21. This is an optional means for pivoting a restrainer wall in the entryway as the input door 4 is opened.

Figure 12:
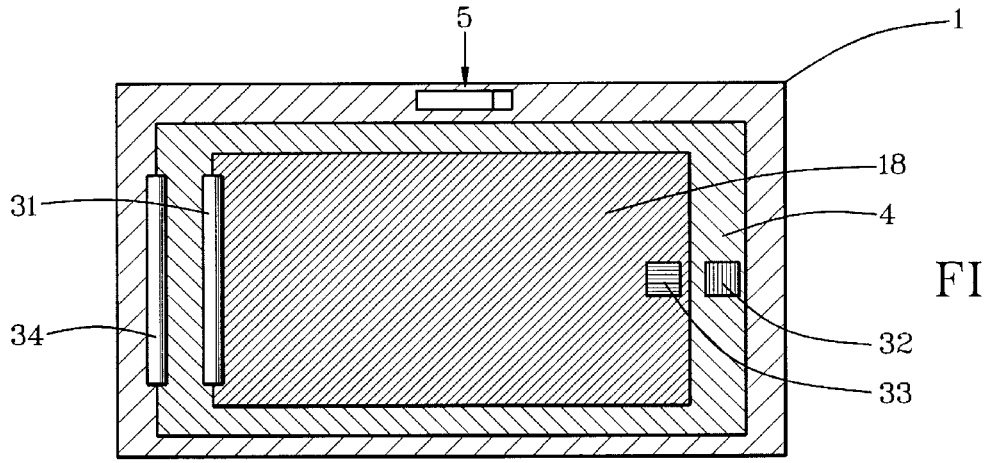
FIG. 12 is a front elevation view of a delivery container having an outlet door in an input door.
Figure 13:
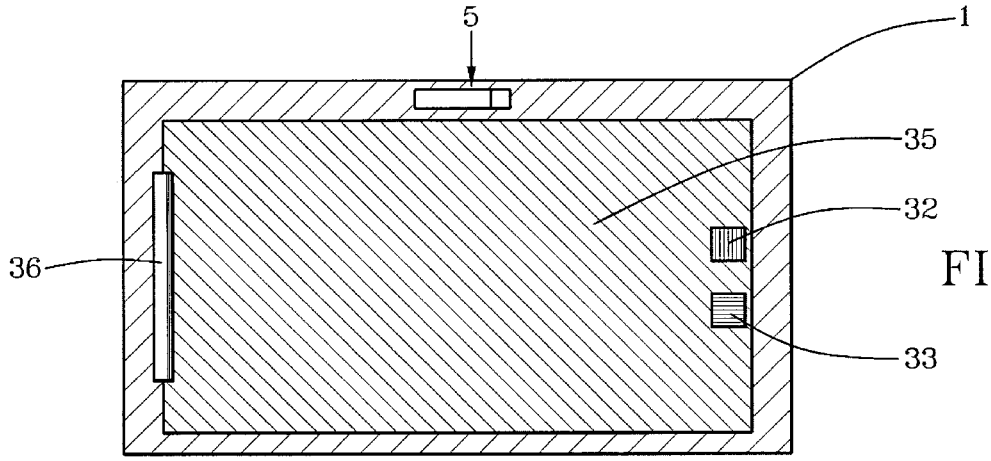
FIG. 13 is a front elevation view of a delivery container having an outlet door and an input door that are the same door with separate locks.
Figure 14:
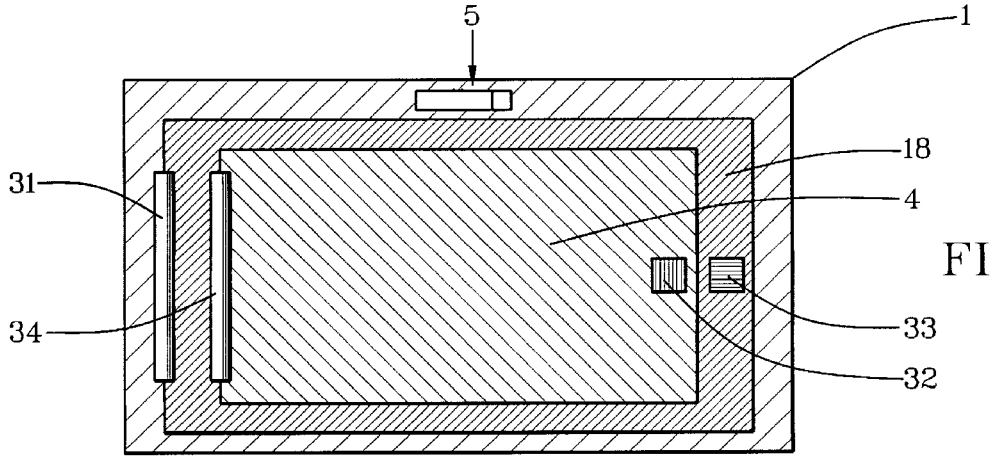
FIG. 14 is a front elevation view of a delivery container having an input door in an outlet door.

Referring to FIGS. 12–14, the input door 4 and the outlet door 18 can be on the same side or face of a delivery container 1 by appropriate positioning of doors, hinges and locks. In FIG. 12, an outlet door 18 is in the input door 4 by hinging the outlet door 18 onto the input door 4 with outlet hinge 31. The input door 4 is hinged to the delivery container 1. The input door 4 has an input locking means 32 that is separate from an outlet locking means 33. The input door 4 has an input hinge 34 with which it is hinged to the delivery container 1.

In FIG. 13, the outlet door 18 also is the input door 4 with an outlet locking means 33 that is separate from an input locking means 32 that is computer controllable. Separate locks for input and outlet result in a double-access door 35 with a double-access hinge 36.

In FIG. 14, an input door 4 is in the outlet door 18 by hinging the input door 4 onto the outlet door 18 with input hinge 34. The outlet door 18 is hinged to the delivery container 1. The input door 4 has an input locking means 32 that is separate from an outlet locking means 33. The outlet door 18 has an outlet hinge 31 with which it is hinged to the delivery container 1.

Figure 15:
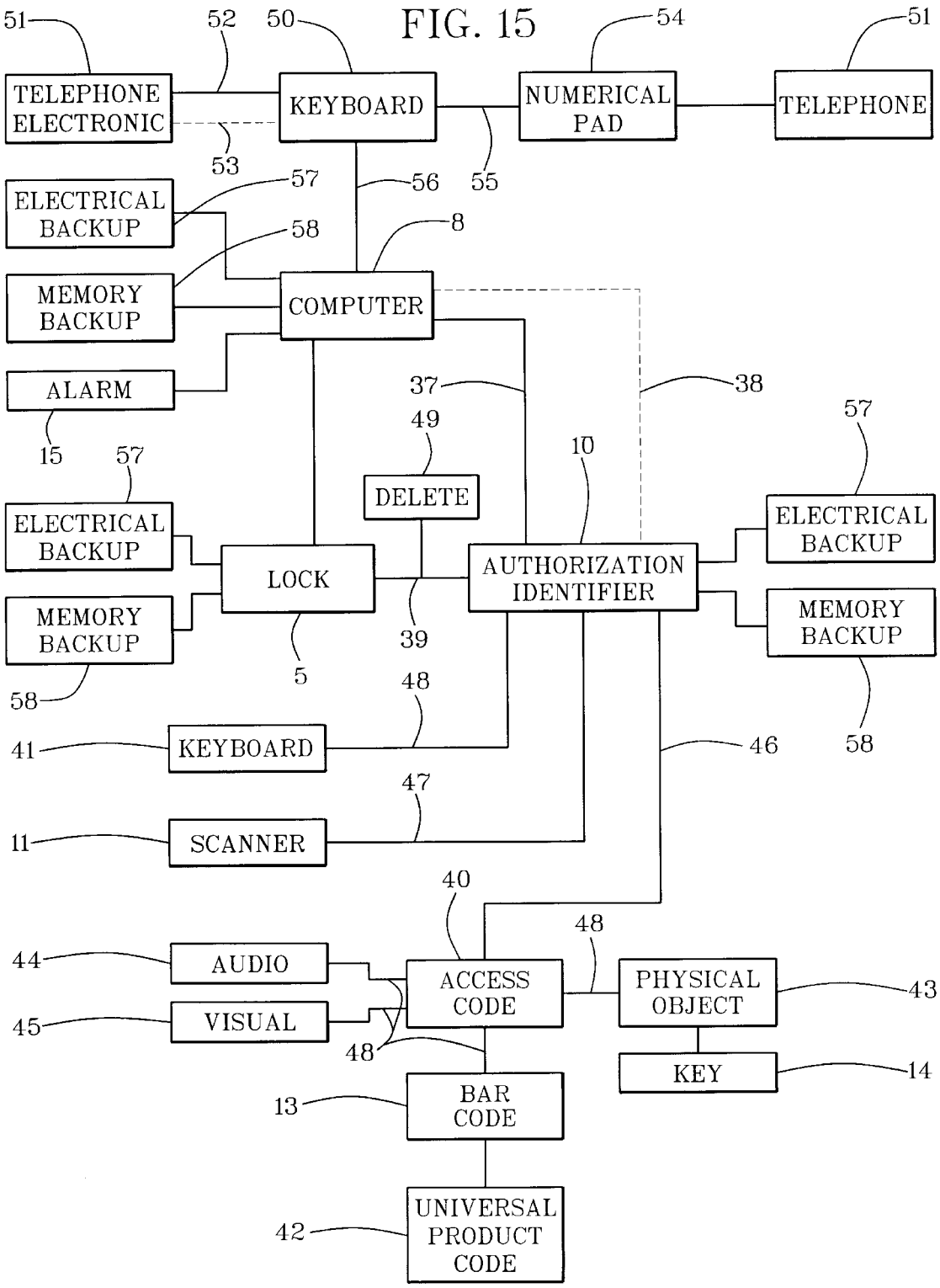
FIG. 15 is a schematic representation of the computerized delivery-acceptance system.

Referring to FIG. 15, the computer 8 is in computer-controllable communication with the authorization identifier 10 by means of a computer-output line 37 and/or a computer-output radio wave 38. To lock and unlock the computer-controllable lock 5 by computer communication through lock-authorization line 39, the authorization identifier 10 is programmed to function in response to an access code 40 that is computer-recognized through the scanner 11. In addition to being programmable through the computer 8, the authorization identifier 10 also can be programmed through an authorization keyboard 41 in relation scanner 11 identification by access code 40.

The access code 40 can be a bar code 13, a universal product code 42 or infrared code, or a physical object 43 such as a key 14, a picture, a color, a shape, magnetic strip or other physical identity. Additionally, the access code 40 can be in communication by audio 44 means and/or visual 45 means. Code-communication lines 46, scanner-communication line 47, and authorization-keyboard line 48 are provided accordingly.

A timed delete 49 can be programmed into the computer-controllable lock 5 and/or the authorization identifier 10. Alternatively, an automatic delete can be programmed so that when a deliverer scans and opens the access door, that programed access code can be canceled. This prevents an authorized individual from gaining access legitimately and then using it illegitimately later.

The computer 8 can be programmed with a computer keyboard 50 and/or with telephone electronics 51 that can be in communication through a telephone line 52 or a telephone radio wave 53. Optionally also, the computer keyboard 50 can have a numerical pad 54 or can utilize a numerical panel of a telephone 51 for computer programming the computer 8. Keyboard lines 55 and computer-input lines 56 are provided accordingly. An alarm 15 in communication with the computer 8 can be provided to warn of any malfunction and/or unauthorized function.

An electrical backup 57 and a memory backup 58 can be provided for the computer 8, the computer-controllable lock 5 and the authorization identifier 10 in accordance with design preference.

A new and useful computerized delivery-acceptance system having been described, all such modifications, adaptations, substitutions of equivalents, mathematical possibilities of combinations of parts, pluralities of parts, applications and forms thereof as described by the following claims are included in this invention.

Having thus described my invention, I claim:

1. A computerized delivery-acceptance system comprising:

a delivery container that is sized, shaped and structured to receive delivery of items for a desired building;

a door having both input locking means and output locking means, the input locking means being a computer-controllable lock in locking relationship between the door and the delivery container and the output locking means having a lock separate from the computer-controllable lock in controlled communication with the delivery container;

an authorization identifier that is computer programmable to unlock the computer-controllable lock of the input means on the input door; and a computer in control communication with the computer-controllable lock and the authorization identifier.

2. A computerized delivery-acceptance system as described in claim 1 wherein:

the delivery container is outside the desired building.

3. A computerized delivery-acceptance system as described in claim 1 wherein:

the computer is programmable for control of the computer-controllable lock and the authorization identifier selectively.

4. A computerized delivery-acceptance system as described in claim 3 wherein:

the computer is programmable for operation of the authorization identifier with an access code.

5. A computerized delivery-acceptance system as described in claim 4 wherein:

the access code is a bar code.

6. A computerized delivery-acceptance system as described in claim 5 wherein:

the bar code is a universal product code.

7. A computerized delivery-acceptance system as described in claim 4 wherein:

the access code is audio.

8. A computerized delivery-acceptance system as described in claim 4 wherein:

the access code is visual.

9. A computerized delivery-acceptance system as described in claim 4 wherein:

the access code is audio and visual selectively.

10. A computerized delivery-acceptance system as described in claim 3 wherein:

the computer is programmable for operation of the authorization identifier with a physical object.

11. A computerized delivery-acceptance system as described in claim 10 wherein:

the physical object is a key.

12. A computerized delivery-acceptance system as described in claim 3 wherein:

the computer is programmable for operation of the authorization identifier with a physical object and an access code selectively.

13. A computerized delivery-acceptance system as described in claim 1 wherein:

the computer is programmable for operation of the authorization identifier with a physical object.

14. A computerized delivery-acceptance system as described in claim 13 wherein:

the physical object is a key.

15. A computerized delivery-acceptance system as described in claim 1 wherein:

the computer is programmable with a keyboard.

16. A computerized delivery-acceptance system as described in claim 15 wherein:

the keyboard is a numerical panel.

17. A computerized delivery-acceptance system as described in claim 15 wherein:

the keyboard is a telephone keyboard.

18. A computerized delivery-acceptance system as described in claim 1 wherein:

the computer is programmable remotely by electronic communication.

19. A computerized delivery-acceptance system as described in claim 18 wherein:

the electronic communication is with a telephone.

20. A computerized delivery-acceptance system as described in claim 18 wherein:

the electronic communication is with radio signals.

21. A computerized delivery-acceptance system as described in claim 18 wherein:

the electronic communication is with telephone and radio signals selectively.

22. A computerized delivery-acceptance system as described in claim 1 wherein:

the authorization identifier is programmable with a keyboard.

23. A computerized delivery-acceptance system as described in claim 1 wherein:

the authorization identifier is an electronic scanner.

24. A computerized delivery-acceptance system as described in claim 1 wherein:

the authorization identifier is a keyboard and an electronic scanner that are operable selectively.

25. A computerized delivery-acceptance system as described in claim 1 wherein:

the computer is programmable to store coded information for computer control of the computer-controllable lock and the authorization identifier selectively.

26. A computerized delivery-acceptance system as described in claim 24 or 25 wherein:

the computer is programmable to delete the coded information after a predetermined time period.

27. A computerized delivery-acceptance system as described in claim 1 wherein:

coded information that is recognizable by the authorization identifier is positional on and in items selectively for delivery to the delivery container.

28. A computerized delivery-acceptance system as described in claim 27 wherein:

the coded information is magnetic.

29. A computerized delivery-acceptance system as described in claim 27 wherein:

the coded information is a visual code.

30. A computerized delivery-acceptance system as described in claim 27 wherein:

the coded information is electronic.

31. A computerized delivery-acceptance system as described in claim 27 wherein:

the coded information is a physical form.

32. A computerized delivery-acceptance system as described in claim 1 and further comprising:

memory backup for the computer, the computer-controllable lock and the authorization identifier selectively.

33. A computerized delivery-acceptance system as described in claim 32 and further comprising:

electrical power backup for the computer, the computer-controllable lock and the authorization identifier selectively.

34. A computerized delivery-acceptance system as described in claim 1 and further comprising:

delivery indicia proximate the delivery container; and the delivery indicia being detectable remotely of existence of a delivery to the delivery container.

35. A computerized delivery-acceptance system as described in claim 1 and further comprising:

an alarm system proximate the delivery container; and the alarm system being communicative remotely of functional problems such as malfunctions, attempted burglary, misuse, open input door, open outlet door, power outage and computer error.

36. A computerized delivery-acceptance system as described in claim 1 and further comprising:

a delivery recorder on the delivery container.

37. A computerized delivery-acceptance system as described in claim 1 and further comprising:

a weather-protective cover on the delivery container.

38. A computerized delivery-acceptance system as described in claim 1 and further comprising:

a restrainer wall attached pivotally to an edge of an entryway in which the input door is in communication with the delivery container; and the restrainer wall being pivotal to a delivery-container-closed position by pivotal opening of the input door and being pivotal to a delivery-container-open position by pivotal closing of the input door, such that access to a building to which the delivery container is attached or access to a delivery container containing one or more previous delivery items is restrained designedly by the restrainer wall when the input door is open and delivery items are being placed in the delivery container.

* * * * *